US010415261B2

(12) United States Patent
Allen et al.

(10) Patent No.: US 10,415,261 B2
(45) Date of Patent: Sep. 17, 2019

(54) OUTRIGGER SUPPORT

(71) Applicants: Darrell Allen, Agoura Hills, CA (US); Gary Hardy, Santa Barbara, CA (US)

(72) Inventors: Darrell Allen, Agoura Hills, CA (US); Gary Hardy, Santa Barbara, CA (US)

( * ) Notice: Subject to any disclaimer, the term of this patent is extended or adjusted under 35 U.S.C. 154(b) by 0 days.

(21) Appl. No.: 16/379,632

(22) Filed: Apr. 9, 2019

(65) Prior Publication Data

US 2019/0234086 A1 Aug. 1, 2019

Related U.S. Application Data

(63) Continuation-in-part of application No. 16/105,870, filed on Aug. 20, 2018, which is a continuation of application No. 15/805,008, filed on Nov. 6, 2017, now Pat. No. 10,053,878.

(60) Provisional application No. 62/415,685, filed on Nov. 1, 2016.

(51) Int. Cl.
*E04G 21/32* (2006.01)
*A62B 35/00* (2006.01)

(52) U.S. Cl.
CPC ..... *E04G 21/3214* (2013.01); *A62B 35/0068* (2013.01); *E04G 21/328* (2013.01)

(58) Field of Classification Search
CPC ..... E04G 21/3214; E04G 21/328; A62B 35/0068
See application file for complete search history.

(56) References Cited

U.S. PATENT DOCUMENTS 752,869 A * 2/1904 Smith ..... E04D 13/03 52/200
3,521,537 A 7/1970 Forni et al.
3,880,405 A 4/1975 Brueske
4,015,827 A 4/1977 Brand
4,037,824 A 7/1977 Whitmer
4,129,197 A 12/1978 Preston
4,171,032 A 10/1979 Woolslayer et al.
4,480,819 A 11/1984 Lopez
4,520,898 A 6/1985 Allemane
4,607,724 A 8/1986 Hillberg
4,616,734 A 10/1986 Phelps et al.
4,809,468 A 3/1989 Bareiss
4,830,341 A 5/1989 Arteau et al.
4,893,736 A 1/1990 Naig
4,932,185 A 6/1990 Lebel
5,011,106 A 4/1991 Cody
5,054,576 A 10/1991 Glynn
5,143,170 A 9/1992 Hunt et al.
5,248,021 A 9/1993 Nichols
5,282,597 A 2/1994 Babcock
5,287,944 A 2/1994 Woodyard
(Continued)

*Primary Examiner* — James M Ference
(74) *Attorney, Agent, or Firm* — Cislo & Thomas, LLP

(57) ABSTRACT

An outrigger beam support that comprises a fall protection anchor that comprises a plate, an anchor post coupled with a first side of the plate, and at least one member on a second side of the plate, the member being substantially perpendicular and spaced inwardly from the plate's perimeter, and the plate and/or member(s) may have holes to accommodate fasteners. The outrigger beam support further comprises a support post with a first end that operatively couples with the anchor post, and a second end of the support post is attached to a beam holder adapted to hold an outrigger support beam.

19 Claims, 15 Drawing Sheets

(56) References Cited

U.S. PATENT DOCUMENTS

| | | | |
|---|---|---|---|
| 5,320,193 | A | 6/1994 | Bongiovanni et al. |
| 5,346,036 | A | 9/1994 | Arisman et al. |
| 5,398,777 | A | 3/1995 | Ouellette et al. |
| 5,454,197 | A | 10/1995 | Horrigan |
| 5,465,533 | A | 11/1995 | Rummo, Jr. et al. |
| 5,553,685 | A | 9/1996 | Cook |
| 5,727,646 | A | 3/1998 | Gray |
| 5,730,245 | A | 3/1998 | Conway |
| 5,730,407 | A | 3/1998 | Ostrobrod |
| 5,829,203 | A | 11/1998 | Ealer, Sr. |
| 5,850,889 | A | 12/1998 | Rexroad et al. |
| 5,941,024 | A | 8/1999 | Journault |
| 5,971,668 | A | 10/1999 | Miller |
| 6,015,139 | A | 1/2000 | Weber |
| 6,173,809 | B1 | 1/2001 | Cole et al. |
| 6,253,875 | B1 | 7/2001 | Trindade et al. |
| 6,520,290 | B1 | 2/2003 | Carter |
| 6,640,495 | B1 | 11/2003 | McKernan |
| 6,668,509 | B1 | 12/2003 | Krebs |
| 6,672,020 | B1 | 1/2004 | Cermola et al. |
| 6,691,826 | B1 | 2/2004 | Dean |
| 6,729,063 | B1 | 5/2004 | Soyko |
| 6,786,020 | B2 | 9/2004 | Poldmaa |
| 6,868,647 | B2 | 3/2005 | Poldmaa |
| 6,966,531 | B2 | 11/2005 | Curtin |
| 7,048,090 | B2 | 5/2006 | Dean et al. |
| 7,063,186 | B1 | 6/2006 | Granke |
| 7,163,083 | B2 | 1/2007 | Argoud |
| 7,207,414 | B2 | 4/2007 | Luke et al. |
| 7,380,373 | B2 | 6/2008 | Crookston |
| 7,528,690 | B2 | 5/2009 | Christmann et al. |
| 7,802,773 | B2 | 9/2010 | Murphy |
| 7,832,153 | B2 | 11/2010 | Crookston |
| 7,861,485 | B1 | 1/2011 | Wentworth et al. |
| 8,025,125 | B2 | 9/2011 | Vetesnik et al. |
| 8,028,477 | B2 | 10/2011 | Crookston |
| 8,056,237 | B1 | 11/2011 | Candler et al. |
| 8,448,745 | B2 | 5/2013 | Crookston |
| 8,448,923 | B1 | 5/2013 | Schad et al. |
| 9,145,705 | B2 | 9/2015 | Herman |
| 2001/0032435 | A1 | 10/2001 | Austin |
| 2002/0079164 | A1 | 6/2002 | Choate |
| 2002/0100636 | A1 | 8/2002 | Cole |
| 2002/0124786 | A1 | 9/2002 | Perkins |
| 2002/0139063 | A1 | 10/2002 | Crane |
| 2003/0006094 | A1 | 1/2003 | Cole |
| 2003/0051429 | A1 | 3/2003 | Hovenier |
| 2004/0010993 | A1 | 1/2004 | Meadowcroft |
| 2004/0041141 | A1 | 3/2004 | Cannon |
| 2004/0154241 | A1 | 8/2004 | Joyce et al. |
| 2004/0173405 | A1 | 9/2004 | Bove |
| 2004/0195041 | A1 | 10/2004 | Vetesnik |
| 2004/0256176 | A1 | 12/2004 | Argoud |
| 2005/0006634 | A1 | 1/2005 | Cuccurullo |
| 2005/0098381 | A1 | 5/2005 | Flaherty |
| 2005/0189171 | A1 | 9/2005 | Bos |
| 2006/0145131 | A1 | 7/2006 | Purvis |
| 2006/0156645 | A1 | 7/2006 | Munday et al. |
| 2006/0289233 | A1 | 12/2006 | Flaherty |
| 2008/0110117 | A1 | 5/2008 | O'Gorman |
| 2010/0031573 | A1 | 2/2010 | Whiting et al. |
| 2010/0032235 | A1 | 2/2010 | Barendregt |
| 2010/0147624 | A1 | 6/2010 | Caylor et al. |
| 2010/0243837 | A1 | 9/2010 | Cox |
| 2010/0326769 | A1 | 12/2010 | Cuccurullo et al. |
| 2011/0083376 | A1 | 4/2011 | Cuccurullo |
| 2012/0073900 | A1 | 3/2012 | Cruz |
| 2012/0186906 | A1 | 7/2012 | Chilton |
| 2012/0216464 | A1 | 8/2012 | Bonapace |
| 2014/0123568 | A1 | 5/2014 | Nurdogan |
| 2014/0224579 | A1 | 8/2014 | Balascak |
| 2014/0339487 | A1 | 11/2014 | Robinson |
| 2014/0346312 | A1 | 11/2014 | Small |
| 2014/0373360 | A1 | 12/2014 | Candler et al. |
| 2015/0075107 | A1 | 3/2015 | Wert et al. |
| 2015/0107184 | A1 | 4/2015 | Nichols, Jr. |
| 2015/0121773 | A1 | 5/2015 | Mills et al. |
| 2015/0275533 | A1 | 10/2015 | Allen et al. |
| 2016/0059054 | A1 | 3/2016 | Csizmadia |
| 2018/0119439 | A1 | 5/2018 | Alien et al. |

* cited by examiner

OUTRIGGER SUPPORT

CROSS-REFERENCE TO RELATED APPLICATION

This patent application is a continuation-in-part of U.S. patent application Ser. No. 16/105,870, entitled "Fall Protection Anchor," and filed Sep. 11, 2018, which is a continuation of U.S. patent application Ser. No. 15/805,008, entitled "Fall Protection Anchor," and filed Nov. 6, 2017, now issued as U.S. Pat. No. 10,053,878, which claims the benefit of U.S. Provisional Patent Application Ser. No. 62/415,685, entitled "Fall Protection Anchor," filed Nov. 1, 2016, which applications are incorporated in their entirety here by this reference.

TECHNICAL FIELD

The present invention relates to a rooftop fall protection anchor with an outrigger support and, more particularly, to a novel fall protection anchor with a detachable outrigger beam support that can support an outrigger beam at or near the rooftop of a building to protect workers on or near the side of a building.

BACKGROUND

Modern safety standards often require workers on rooftops to employ fall protection systems to guard against fall-related injuries and death. For workers on buildings that are under construction, as well as completed buildings, it may be desirable to use a personal fall arrest system ("PFAS"), such as that specified in the United States Code of Federal Regulations (29 C.F.R. § 1926.502(d)). A PFAS typically comprises a body support (safety harness for the worker), an anchor that is securely fastened to the building structure, and a connector between the anchor and the harness. The connector is usually a fabric strap, which in some systems is mounted on a self-retracting reel that can lock if a fall is detected. In other systems the connector may be a shock-absorbing lanyard. The anchor must be securely attached to the building in such a manner that it will withstand the forces of a falling worker. If more than one anchor is placed on a roof, a horizontal lifeline (cable or otherwise) can be attached to or run through one or more anchors, and the connector may be attached to the horizontal lifeline to give the workers more maneuverability along the horizontal lifeline.

Most anchors are geared towards metal-framed buildings, attaching to metal framing members or a concrete deck. In wood-framing applications, the anchors are most often attached to the top of the wooden rooftop sheathing (⅝-inch or 16 mm plywood or the like), or attached to a single framing member through the sheathing. In either application, the fasteners are usually oriented in the same direction, which could in extreme circumstances unduly stress the roof, the framing member, or even cause the fasteners to detach. These applications typically rely on the integrity of the sheathing or the single framing member. What is needed is a fall protection anchor that can be used in wooden or metal framing that spreads the load over a number of framing members, and has fasteners in numerous orientations to spread shear forces.

In addition to the fall protection anchor, outrigger beams are often required so that window washers and other workers may safely descend over the side of a building. In a typical apparatus, the outrigger beam support is a dedicated device with no other use. It is desirable to have a fall protection anchor that could also be used as an outrigger beam support and converted as necessary, and possibly simultaneously serve a dual purpose as both.

SUMMARY

Rooftop anchors are often installed to provide workers with fall protection via a personal fall arrest system ("PFAS"). Such anchors can be temporary for use during construction or reroofing, or permanently installed for use when performing rooftop maintenance, inspection and the like. A PFAS connector can be directly connected to an anchor for use around the anchor. Alternatively, a horizontal line (cable, strap, or the like) can be connected to and/or run through two or more anchors, wherein the PFAS connector can be attached to the horizontal line so the worker can operate along the horizontal line for greater mobility.

A fall protection anchor, particularly for use in wood-framed buildings but not limited thereto, is disclosed herein. Rather than being attached to the roof sheathing or a single framing member, the fall protection anchor disclosed herein attaches to multiple surfaces of the rooftop framing. The construction of the fall protection anchor allows it to attach to both horizontal and vertical framing member surfaces, and further allows the fasteners for the fall protection anchor to penetrate the wood at multiple right angles, spreading the shear forces and increasing the strength of the fall protection anchor.

Also disclosed herein, is an outrigger support that can be attached as needed to the fall protection anchor, so that the fall protection anchor can have a dual function. An outrigger support can be attached to the fall protection anchor, and an outrigger beam can be placed into the outrigger support and the end of the beam towards the inside of the building can be counterbalanced with weights. Alternatively, two fall protection anchor/outrigger supports may be used in a linear configuration so that an outrigger beam is supported by both, which eliminates the need for counterweights, as the inside fall protection anchor/outrigger support secures the free end of the beam. In addition, the fall protection anchor/outrigger support may be equipped with security holes, through which a heavy duty eyebolt, large U-shaped shackle, or other fitting suitable to act as a connection attachment may be used as a secondary fall protection attachment point.

In a first embodiment, the fall protection anchor comprises a rectangular horizontal plate, an anchor connection comprising a vertical anchor post with a top ring mounted in the top center of the horizontal plate, and four vertical plates mounted at right angles to form a rectangular box on the bottom of the horizontal plate. The rectangular box may comprise four individual plates, or one or more plates may be bent to form the box. The rectangular box formed by the vertical plates may be smaller than the square of the horizontal plate, so that the horizontal plate may lie atop the framing members, and may have attachment holes around the edge to accommodate fasteners. Such attachment holes may be countersunk to minimize the protrusion of the fastener head. Likewise, the vertical plates may have a plurality of attachment holes to accommodate fasteners. The vertical post may be round, square, oval, polygonal, or any other suitable shape. Alternatively, the horizontal plate may be configured to at least partially cover two of the horizontal framing members, and the vertical plate(s) on the portion of the plate that does not partially cover a horizontal framing member may be located very close to the edge of the horizontal plate.

In a typical installation of the fall protection anchor, the rooftop framing is constructed just to accommodate the square formed by the vertical plates. The framing may be double thickness around the square to increase the strength of the anchor, provide the fasteners with sufficient material to penetrate, and spread the load along the framing. In addition, blocking may be extended on either side of the fall protection anchor to spread the load to adjacent framing, and construction strapping may be added to the blocking. Fasteners, such as nails, bolts, lag screws, or other heavy duty screws may be used to fasten the horizontal and vertical plates to the framing. The horizontal plate may be installed above or below the rooftop sheathing. Roofing materials may then be applied to seal the vertical post and prevent water penetration.

The fall protection anchor may be compliant with appropriate regulations such as OSHA 1926:502 (1995), ANSI Z359.1-07 (2007), or ANSI 2359.1-07 (2014) or other applicable regulations. Typically, a fall protection anchor must be able to withstand a 5,000 pound (2,268 kg) tensile load, to provide adequate protection during a fall. The fall protection anchor disclosed herein has undergone testing, and meets the minimum standards required for fall protection anchors.

In addition, outriggers are beams that extend over a side of a building, usually to support window washers or other workers on the side of a building. Outrigger beams are also subject to various regulations, such as OSHA 1926:451 and the like. It may be beneficial to have an outrigger beam be attached to one or more fall protection anchors affixed to the roof, and be able to remove the support for the outrigger beam from the fall protection anchor for use on other fall protection anchors, thereby increasing the usefulness of the fall protection anchors and outrigger supports.

In a first embodiment, the fall protection anchor as described above comprises an anchor post, while the outrigger support comprises a support post that slips over the anchor post and is secured by a security fitting that goes through security holes in both the anchor post and the support post. Attached to the top of the support post is a beam holder, which is typically a square metal tube that is adapted to fit the outrigger beam. Where the outrigger support is used with counterweights, the beam holder may be installed at an angle, or with a pivot to accommodate various angles. Where two fall protection anchor/beam supports are used to hold an outrigger beam, the beam holder may be attached perpendicular to the support post, or at any angle needed, or a pivoting mount may be used between the support post and the beam holder. The anchor post may be equipped with a stop ring to properly locate the support post atop the anchor post, particularly to line up the security holes of the anchor post and support post. In a second embodiment, the anchor post may slip over the support post. In a third embodiment, the anchor post may be eliminated, and the support post may be permanently attached to the plate. Other embodiments are disclosed herein.

Accordingly, it is an object of the present invention to provide an improved fall protection anchor with a detachable outrigger support. Other and further objects and advantages will appear hereinafter.

DETAILED DESCRIPTION OF THE INVENTION

Figure 1:
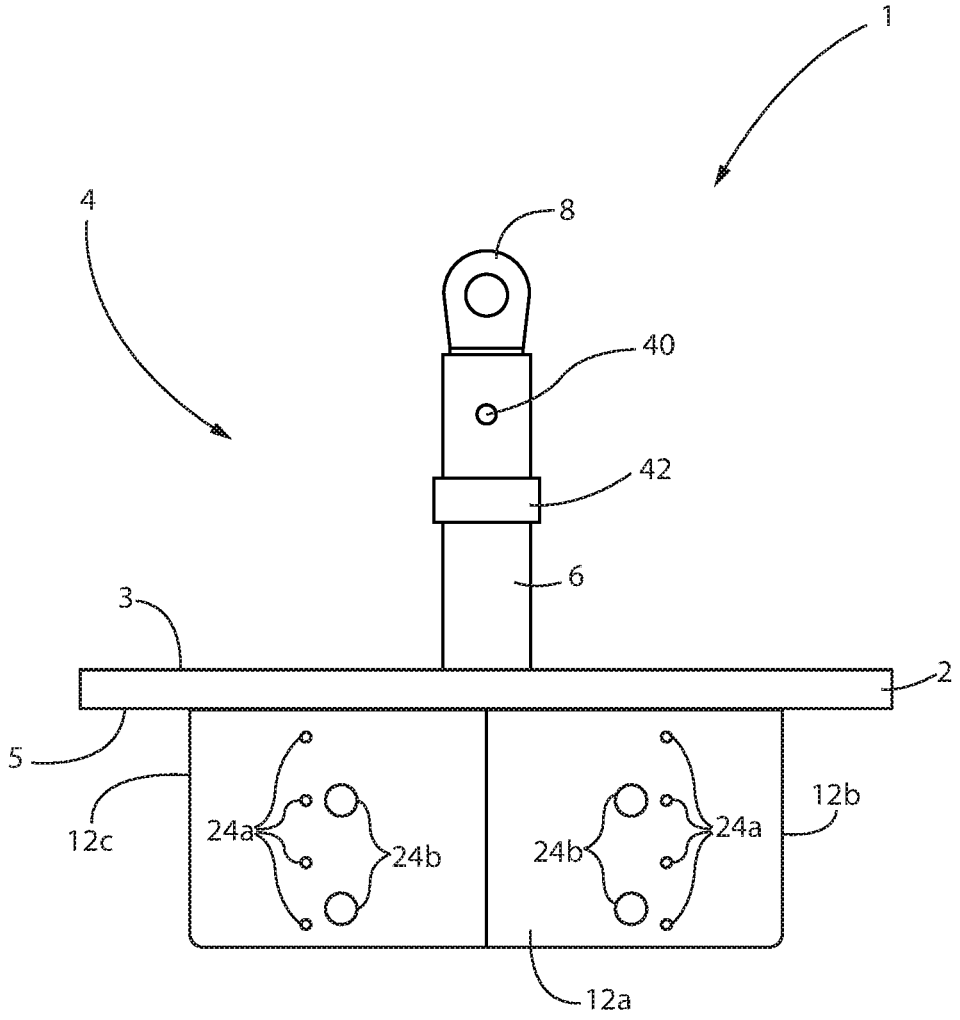
FIG. 1 depicts a side view of a fall protection anchor.
Figure 2:
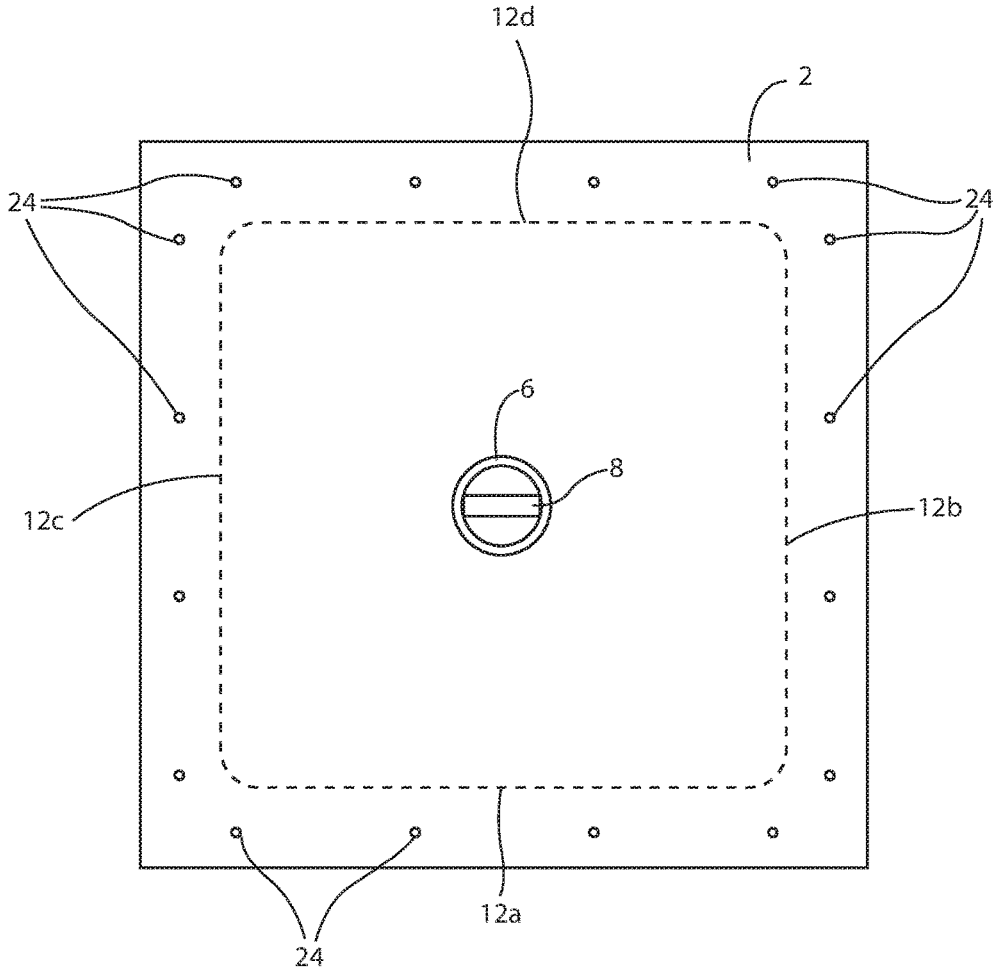
FIG. 2 depicts a top view of a fall protection anchor.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Rooftop safety anchors are used to protect rooftop workers from falls. Anchors can be used as part of a support or suspension system, or may be as an auxiliary fall protection independent of such systems. A PFAS typically comprises a body support (safety harness for the worker), an anchor that is securely fastened to the building structure, and a connector between the anchor and the harness. The present invention focuses on the anchor.

As shown in FIGS. 1-4 and 6-8, the fall protection anchor 1 disclosed herein may be used for support, suspension, or fall protection. FIGS. 1-4 show that the fall protection anchor 1 may include a horizontal plate 2, which is preferably square or rectangular to correspond to typical building framing. The horizontal plate 2 has a top surface 3 and a bottom surface 5. Coupled with the top surface 3 of the horizontal plate 2, preferably near the middle, is the anchor connection 4, which may comprise an anchor post 6 and/or a connection attachment 8. If an anchor post 6 is used, the bottom end is preferably mounted perpendicular to the top of the horizontal plate 2, and may be any suitable length, although a preferred embodiment may have a post length of approximately 16 inches (400 mm). The anchor post 6 may be hollow or solid, and may have any suitable cross section, including but not limited to square, round, oval, or polygonal, and may be constructed of any suitable material that has sufficient strength and durability to survive the elements. In a preferred embodiment, the anchor post 6 may be constructed of 3.5 inch (90 mm) square steel tubing with 0.375 inch (10 mm) wall thickness. In an alternative preferred embodiment, the anchor post 6 may be a cylindrical pipe with a 4-inch outer diameter and a 3.5-inch inner diameter, although other diameters and wall thicknesses may be used, such as x-strong and xx-strong pipe. The anchor post 6 may be coupled with the horizontal plate 2 in any suitable manner, but the preferred attachment method is welding. The preferred material for the anchor post 6 is steel and its alloys, either stainless steel or non-stainless steel coated with anti-corrosion material such as zinc, galvanizing, coatings, or the like. Preferably, if non-stainless steel is used for the horizontal plate 2 and the anchor post 6 and/or connection attachment 8, after the anchor post 6 and/or connection attachment 8 is welded to the horizontal plate 2, the entire assembly or portions of the assembly may be given anti-corrosion treatment. A hole may be located in the plate within the interior of the anchor post 6, or anywhere along the anchor post 6 to relieve pressure during galvanizing or other anti-corrosion treatments. This hole may be plugged after treatment to prevent water intrusion.

The connection attachment 8 may be a ring or eyebolt of a suitable diameter to attach or insert a connection device 10 such as a snaphook, carabiner, cable, horizontal lifeline, webbing, etc. The connection attachment 8 may be used without the anchor post 6, coupled with the horizontal plate 2. The connection attachment 8 could be a structure other than a simple ring, such as a D-ring, swivel, a locking clip, or any other suitable attachment. The connection attachment 8 is preferably made of steel, which may be forged or otherwise strengthened or inherently strong enough to withstand significant forces generated during a fall. Alternatively, the connection attachment may be made of any other suitable material that can withstand such forces. In a preferred embodiment, the connection attachment 8 may comprise a 0.5-inch steel plate placed horizontally across the top of the anchor post 6, and welded or otherwise attached to the anchor post 6, with a 4-inch×4-inch square of steel plate with a 2-inch diameter eyelet, welded or otherwise attached vertically to the horizontal steel plate. This 4×4 steel plate may have its top two corners rounded for safety and/or ease of use, but preferably there will be at least a continuous 1-inch annulus of steel plate material bounded by the rounded top corners. Preferably the connection attachment 8 will have anti-corrosive properties or an anti-corrosive finish. Preferably the connection attachment 8 will have a relatively smooth finish to prevent abrasion of the connection device 10. The connection attachment 8 may be coupled with the horizontal plate 2 or the anchor post 6 by any suitable means, including but not limited to welding, adhesives, threaded connections, etc. If a removable coupling is used, such as a threaded connection, it may include some means of preventing accidental loosening, such as a cotter pin, keyway, thread locking adhesive, split-lock, locking nut, lock washers, or even a weld.

Alternatively, the anchor connection 4 may be coupled with the horizontal plate 2 by the connection attachment 8 comprising an eye bolt or equivalent with a long shank (not shown) that can extend through the anchor post 6 and a small hole (not shown) in the horizontal plate 2, wherein the threads of the shank are secured to the bottom surface 5 of the horizontal plate 2 with a nut or other suitable retention element, or the shank could be welded to the horizontal plate 2.

Figure 3:
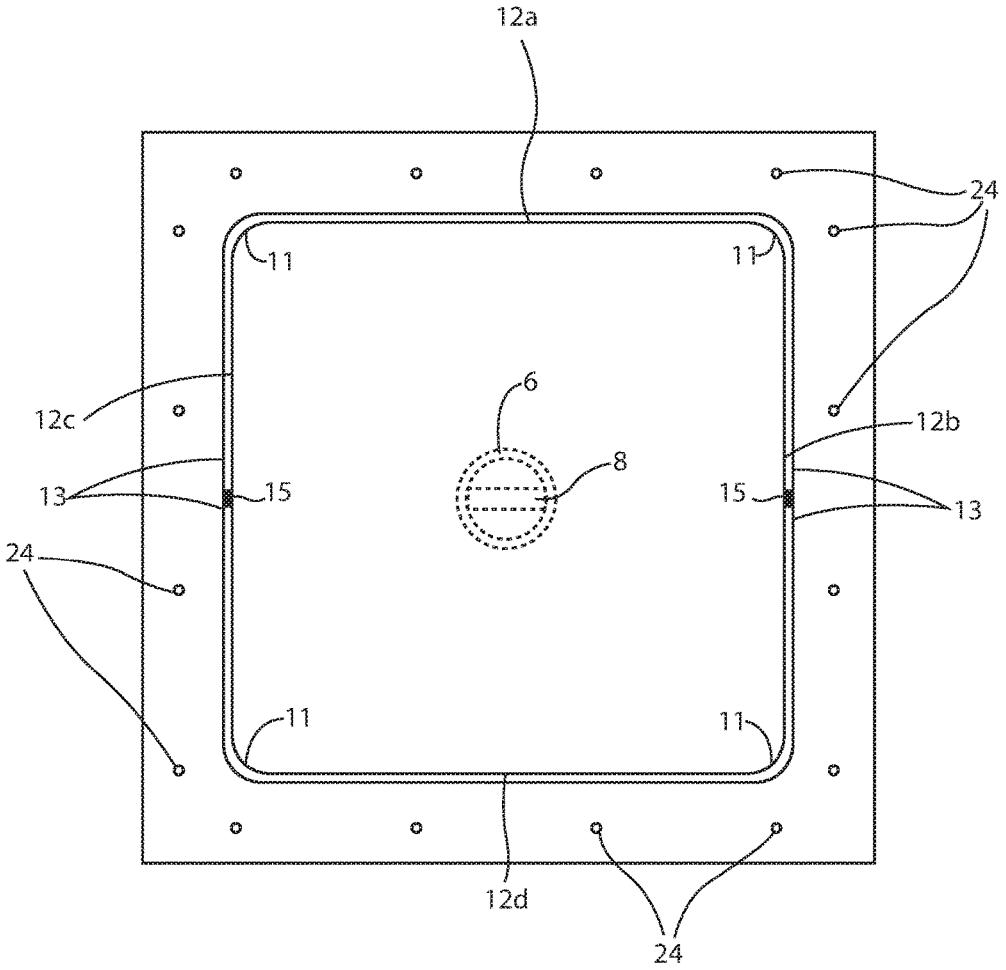
FIG. 3 depicts a bottom view of a fall protection anchor.

Coupled to the bottom surface 5 of the horizontal plate 2 is at least one vertical member 12. Preferably there are four vertical members 12*a*, 12*b*, 12*c*, and 12*d*, which are substantially planar and preferably rectangular, and may be coupled with the horizontal plate 2 along their length, with each plate perpendicular to the adjacent plates such that they form a rectangular box when viewed from the bottom. The ends of the vertical members 12*a*, 12*b*, 12*c*, and 12*d* may be coupled together to close the rectangular box, or the ends may be separated by a distance. The vertical members 12*a*, 12*b*, 12*c*, and 12*d* may be constructed of steel, and may be coupled to the horizontal plate 2 by welding. Welding all the short edges of the vertical members 12*a*, 12*b*, 12*c*, and 12*d* together such that they form a square or rectangular box may strengthen the vertical members. In alternative embodiments, the vertical member(s) 12 may comprise non-planar configurations, such as tubing, bar stock, or the like, and/or non-rectangular configurations of any suitable shape. In one of those alternative embodiments, as shown in FIG. 3, the vertical members 12 may be comprised of one or two rectangular steel plates, bent at 90 degrees in one or more locations to form the corner(s) 11 of the rectangular box. The ends of these bent plates 13 may be welded together for extra strength. Such welds 15 could be on one or more of the rectangular box corners 11, or in the straight portion of the vertical member as shown in FIG. 3.

Preferably, the horizontal plate 2 is 0.5 inch (13 mm) to 0.75 inch (19 mm) thick steel plate, and the vertical members 12 are 0.25 inch (6 mm) thick steel plate. Preferably, the horizontal plate 2 is square, 18.5 inches (470 mm) along each side. Preferably, the vertical members are approximately 14.375 inches (365 mm) long and 7.25 inches (185 mm) wide, so that the square formed by four vertical members 12*a*, 12*b*, 12*c*, and 12*d* is 14.375 inches (365 mm) along each side, and extend generally perpendicularly 7.25 inches below the bottom surface 5 of the horizontal plate 2. In such an embodiment the bottom surface 5 of the horizontal plate extends approximately 2.0 inches (50 mm) beyond the sides of the rectangular box formed by the vertical members 12*a*, 12*b*, 12*c*, and 12*d*. The thicknesses and dimensions of the plates may be thicker or thinner than stated above, and the thickness ratio between the horizontal plate 2 and the vertical member(s) 12 of 2:1 or 3:1 may be different as well. Suitable materials other than steel may also be used for their construction. In some embodiments, any number of vertical members 12 may be used, including but not limited to one, two, three, or four vertical members. Those vertical members may be formed from individual steel plates, or one steel plate bent at 90 degrees in one or more places to form one or more of such vertical members 12. For example, one 90 degree bend could result in two vertical members, 12*a* and 12*b*. Two 90 degree bends could result in a broad "U-shaped" element comprising three vertical members, 12*a*, 12*b*, and 12*c*, and the "vertical" portions of the U-shape could extend all the way to the corners of the framing, or somewhere in between. As shown in FIG. 3, two U-shaped members may be used to form four vertical members 12*a*, 12*b*, 12*c*, and 12*d*. Alternatively, one plate could be bent with four corners to form vertical members 12*a*, 12*b*, 12*c*, and 12*d*.

Figure 4:
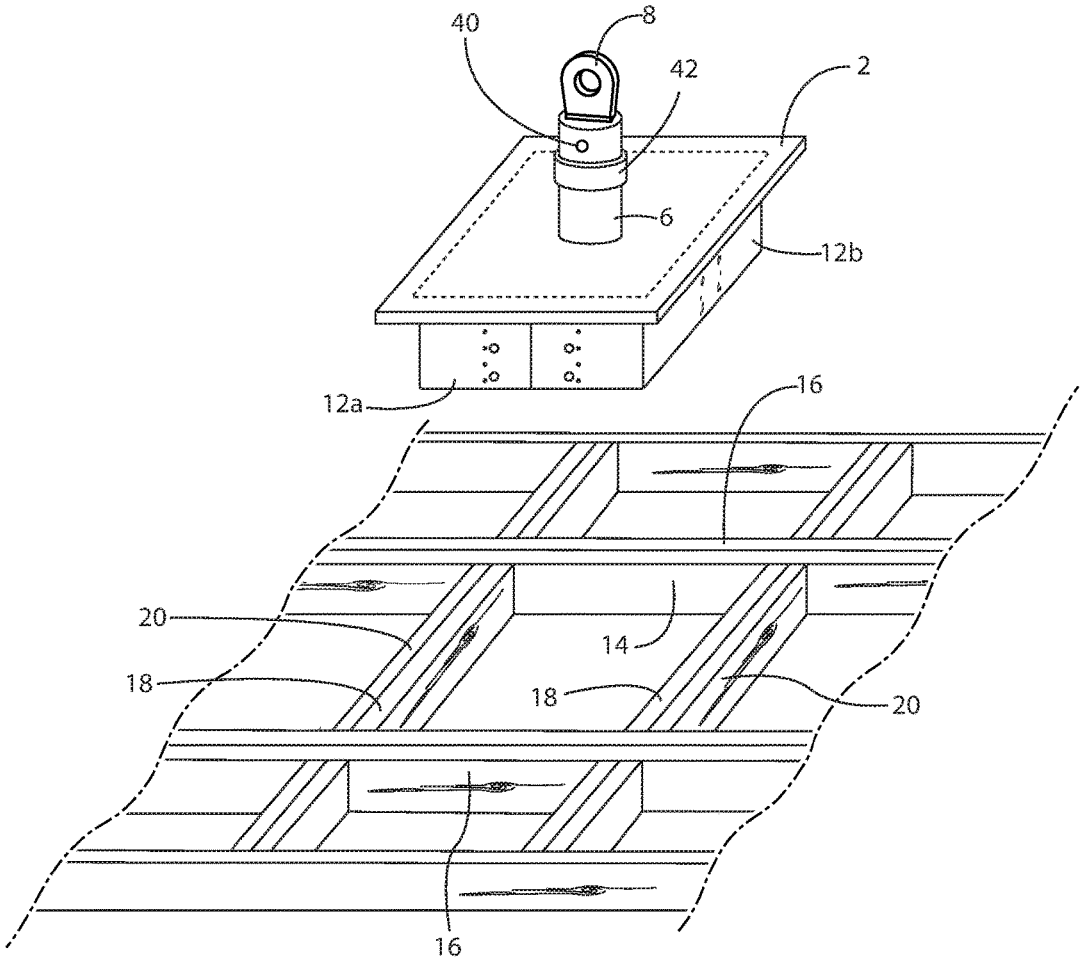
FIG. 4 depicts a perspective view of a fall protection anchor before it is placed into framing members.
Figure 5:
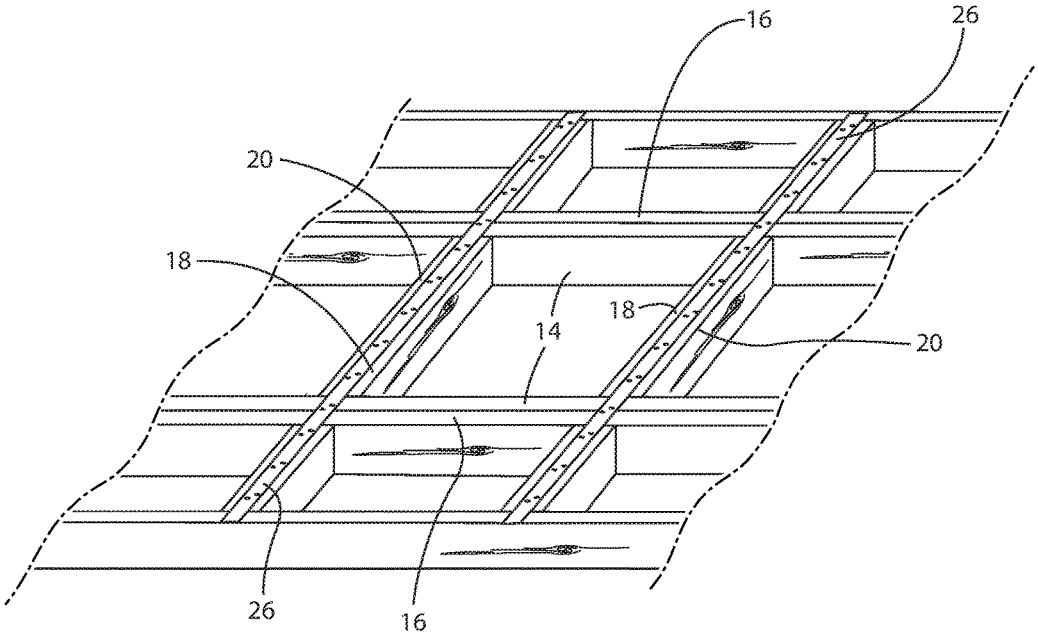
FIG. 5 depicts a perspective view of framing members with strapping, ready to accept a fall protection anchor.
Figure 6:
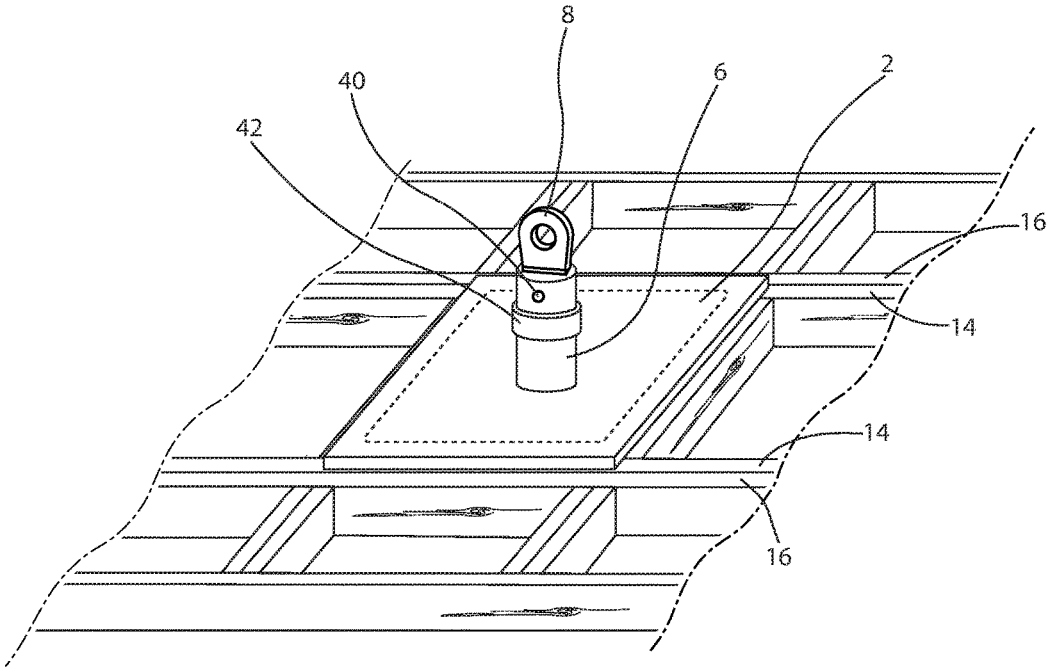
FIG. 6 depicts a perspective view of a fall protection anchor after it is placed into framing members.
Figure 7:
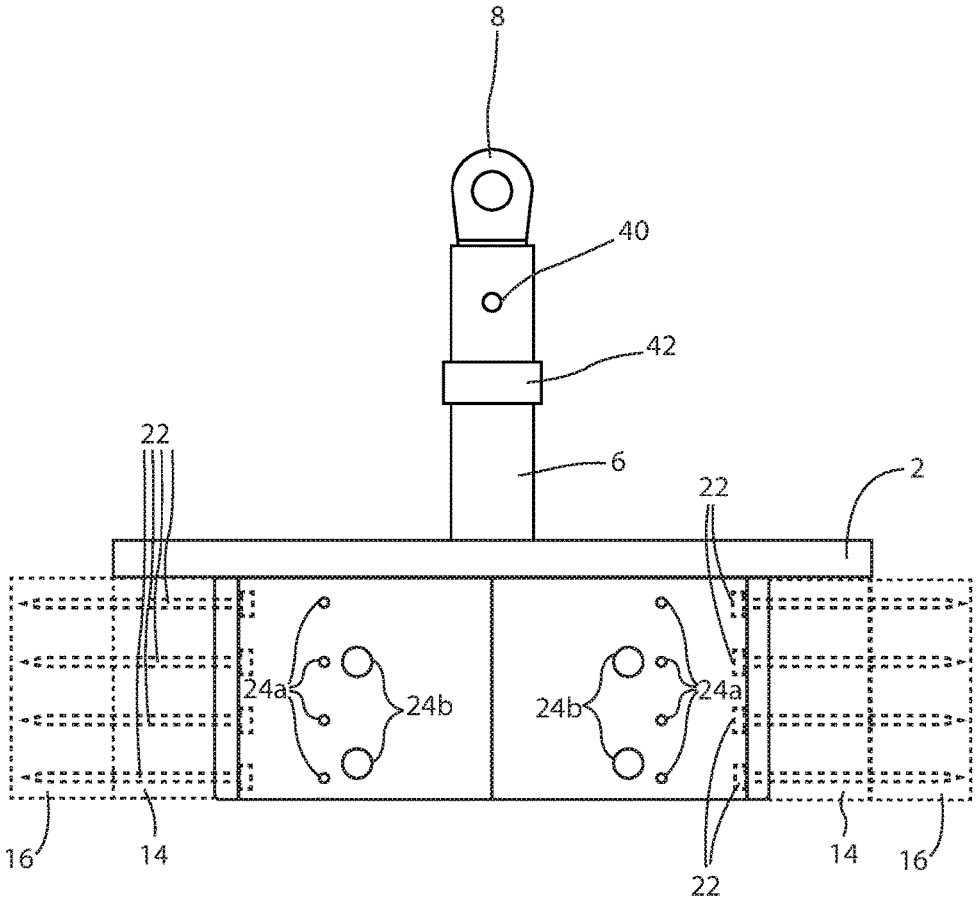
FIG. 7 depicts a side cut-away view of a fall protection anchor installed into the framing members.

As shown in FIGS. 4-6, the fall protection anchor 1 may be designed to fit within standard wooden rooftop framing that is spaced 16 inches (405 mm) on center. Such spacing results in a framing opening that is typically 14.5 inches (368 mm) wide, which will accommodate the 14.375 inches (365 mm) square formed by the vertical members 12*a*, 12*b*, 12*c*, and 12*d* with a minimum of play. The horizontal plate 2 will preferably at least partially cover all four of the timbers of the rectangle of horizontal framing 14 and 18.

In an alternative embodiment, the horizontal plate 2 may be sized to cover only two or three timbers of horizontal framing (14 or 18), either completely or partially. In such an embodiment, the portion of the horizontal plate 2 that covers the horizontal framing members (14 or 18) act as supports for the fall protection anchor 1, while fasteners 22 are installed into the horizontal framing (14 or 18), through attachment holes 24 either in the vertical members 12, horizontal plate 2, or both. In such an embodiment, the side(s) of the horizontal plate 2 that do not cover a timber of horizontal framing (14 or 18) may have the vertical plate(s) 12 installed at or close to the edge of the horizontal plate 2, and those vertical plates 12 may face the horizontal framing (14 or 18) that are not covered by the horizontal plate 2, and fasteners 22 may be used to fasten those vertical members 12 to those horizontal framing timbers (14 or 18).

In a typical installation, the roof framing is constructed of long timbers 14 (joists, rafters, purlins, etc.) in at least one direction, with typical lumber dimensions of 2×8, 2×10, 2×12, etc. or the metric equivalent. Preferably, where the fall protection anchor 1 is to be installed, the framing will comprise two first long timbers 14 that are spaced 16 inches (405 mm) on center to provide a 14.5 inch opening. On the outsides of each of the first long timbers 14 there may be a second long timber 16 so that there is a double thickness of the long timber on each side while maintaining the 14.5 inch opening. Two first blockings 18, the same lumber dimension as the long timbers 14, 16 (2×8, 2×10, 2×12, etc.) may be installed perpendicular to the first long timbers 14 to form a 14.5 inch square (rectangle) of substantially horizontal framing members. Then two second blockings 20 may be placed on the outside of each of the first blockings 18, to achieve a double thickness of blocking. Alternatively, double thickness long timber and/or blocking may be used (4×8, 4×10, 4×12, etc.). The double thickness may provide added strength to the installation, although in some applications a double thickness of long timber and/or blocking may not be required to achieve the necessary strength. The blocking 18, 20 is installed with typical framing fasteners 22 such as nails or screws, although heavy duty construction fasteners may be used, as well as brackets or hangers suitable for the task. The framing opening for the fall protection anchor 1 may be atop or adjacent to a wall on the floor below, to provide additional support for the framing supporting the fall protection anchor 1. Preferably the fasteners 22 will penetrate at least 75 percent of the total thickness of the double thickness of long timber and/or blocking, although more or less penetration could be used, including 100 percent penetration for through-bolt fasteners.

The double thickness of long timbers may be continued for approximately 72 inches (1830 mm) or other suitable distance on the sides of each of the first long timbers 14. Likewise, as shown in FIG. 4, the blocking and/or double blocking may be continued onto nearby horizontal framing, which should provide additional strength to the installation by spreading the load among more framing members. As shown in FIG. 5, above and/or below the blocking, a continuous piece of construction strapping (Simpson CS/CMST or the like) 26 may be installed with appropriate fasteners 22, which may also add strength to the blocking and the overall installation.

In the case of truss framing, or other framing where the long timbers are spaced wider than 16 inches on center, the horizontal plate 2 and the vertical members 12*a*, 12*b*, 12*c*, and 12*d* may be enlarged to accommodate such framing. Alternatively, additional timbers (not shown) may be placed inboard of one or more long timbers until the opening is 14.5 inches wide to accommodate the above-described embodiment of the fall protection anchor 1. Suitable structural fasteners and/or adhesives should be used to secure the additional timbers to the framing. Blocking, double or single, may be placed between the additional timbers to form a 14.5-inch opening for the fall protection anchor 1. As shown in FIG. 5, above and/or below the blocking, a continuous piece of construction strapping (Simpson CS/CMST or the like) 26 may be installed with appropriate fasteners 22, which may also add strength to the blocking and the overall installation.

As shown in FIGS. 1-4, in a preferred embodiment, the horizontal plate 2 and/or the vertical members 12*a*, 12*b*, 12*c*, and 12*d* are equipped with attachment holes 24 (24*a* and 24*b*) to accommodate fasteners 22. The fasteners are typically driven through the attachment holes 24 and into the framing, and the head of the fastener 22 holds the plates securely to the framing 14 and 18, and/or 16 and 20. The fasteners 22 for attachment holes 24*a* may be nails, screws, bolts and nuts, lag screws, or other suitable fasteners for attaching structural steel to wooden or steel framing. If screws are used in wood framing, they may be heavy duty construction screws, such as Simpson SDS, USP WS, or the like. Preferably, the fasteners 22 will be of sufficient length so that when placed in the vertical members 12 they will penetrate both the first and second long timber 14, 16 and blocking 18, 20. Alternatively, the fasteners 22 may only need to be long enough and/or thick enough to provide the necessary strength for the application. If large bolts and nuts are used as fasteners 22, larger attachment holes 24*b* may be used to accommodate them.

The attachment holes 24 in the horizontal plate 2 may accommodate fasteners 22 to resist shear and tension uplift. The horizontal plate 2 sets on top of the framing 14, 16, 18, 20 to provide compression for the fall protection anchor 1. Both tension and compression forces allow the fall protection anchor 1 to work properly. The vertical members 12*a*, 12*b*, 12*c*, and 12*d*, below the horizontal plate 2 also work in shear, tension and compression. These components working together allow the fall protection anchor 1 to minimize movement at the connection attachment 8 atop the anchor post 6. The connection attachment 8 should have sufficient tensile and shear strength to resist a load of at least 5000 lbs. applied at any angle to the connection attachment, as required by 29 C.F.R. Section 1926.502(d), as well as other applicable regulations.

In a preferred embodiment, to accommodate the fasteners 22, there may be sixteen attachment holes 24 in the horizontal plate, approximately 0.3125 inches (8 mm) in diameter, evenly spaced around the perimeter, approximately halfway between the edges of the horizontal plate 2 and the vertical members 12, although they could be spaced such that the fasteners 22 penetrate the approximate center of the framing members surrounding the vertical members 12. In a preferred embodiment, there may be six or nine similarly sized attachment holes 24 in each of the vertical members 12*a*, 12*b*, 12*c*, and 12*d*, which may be arranged in two or three vertical rows per vertical member, where the end rows are spaced approximately 2.0 inches (50 mm) from the ends of the vertical member, and the three holes 24 in each vertical row are spaced 2.0, 4.0, and 6.0 inches from the bottom surface 5 of the horizontal plate. Alternatively, the attachment holes 24 in the vertical members 12 may be arranged in other manners, such as a singular or repeating "W" or "X" pattern, or in other patterns so that the fasteners 22 of the horizontal plate 2 do not interfere with the fasteners 22 of the vertical members 12*a*, 12*b*, 12*c*, and 12*d*, but are far enough from the edges of both the vertical members and the framing members to provide sufficient strength for each. The fasteners 22 may have a shank thickness that is approximately 0.25 inches (6 mm) to fit within the attachment holes 24. More or less attachment holes 24 and fasteners 22 may be used, and the holes 24 and fasteners 22 may be larger or smaller. Between the horizontal plate 2 and the vertical members 12*a*, 12*b*, 12*c*, and 12*d*, multiple fasteners are oriented in the x, y, and z axes, which improves both their shear strength and resistance to pull out. Even if only one vertical member 12*a* is used, it still provides attachment holes 24 for fasteners 22 that are oriented perpendicular to the fasteners 22 of the horizontal plate 2, spreading the forces beyond what is possible from just using fasteners and/or plates in a single orientation. If two adjacent vertical members 12*a* and 12*b* are used, then there will be fasteners 22 in all three axes. In an alternative embodiment, no attachment holes 24 and/or fasteners 22 may be used in the horizontal plate 2. Even if fasteners 22 are not used in the horizontal plate 2, there are still fasteners in two axes. The number of fasteners 22 and their spacing also distributes the load to several framing members. The additional blocking beyond the opening for the fall protection anchor 1 may be used to distribute the load to the long timbers that are outboard of the opening that accommodates the vertical members 12.

In addition to or in lieu of the above-described attachment holes 24, larger attachment holes 24*b* may be provided to accommodate large through-bolts as fasteners 22. In a preferred embodiment, two such larger attachment holes 24*b* may be on each vertical member 12 located 1.5 inches above the bottom and 3 inches from the vertical side of each vertical member 12, for a total of eight total larger attachment holes per fall protection anchor 1. These larger attachment holes 24*b* may be 15/16 (0.9375) inches in diameter, to accommodate a 7/8 (0.875) inch bolt fastener 22. Such bolts may be placed through the long timbers of the framing, for a total of four bolts per fall protection anchor 1, although bolts may also or alternatively be used in the blocking. Such bolts may be secured with suitable nuts and washers. In alternative embodiments, there may be more or less larger attachment holes and corresponding bolt fasteners, and the positions of the attachment holes 24*b* may vary. For example, it may be suitable to just use one large bolt fastener 22 centered in each vertical member 12.

Although the preferred embodiment includes multiple attachment holes 24 in the horizontal plate 2 and the vertical members 12, alternative embodiments may have fewer or even no attachment holes 24 in the horizontal plate 2 or the vertical members 12. For example, it may be sufficient to use only one fastener 22 (or multiple fasteners 22) in each vertical member, and no fasteners in the horizontal plate 2. Alternatively, it may be sufficient to use only a few fasteners 22 in the horizontal plate and no fasteners 22 in the vertical members. Although testing (discussed below) shows that using multiple fasteners 22 in both the horizontal plate 2, the vertical members 12, the long timbers 14, 16, and blocking 18, 20, results in a structure that did not fail under mandated loads, further testing may show that fewer or no fasteners 22 in all these structures may still provide the required strength. Testing may further show that blocking 18, 20, is not required for the requisite strength.

Although the preferred embodiments of the fall protection anchor 1 attach the vertical members to the inside surfaces of the horizontal framing 14, 16, 18, 20, alternative embodiments could attach to the outside surfaces of the horizontal framing so that the vertical members 12 essentially surround the horizontal framing rather than sitting inside of it. This would allow workers to attach the fall protection anchor 1 to the horizontal framing from above or the side, rather than having to insert fasteners 22 from underneath. Although the edges of the vertical members could not be connected to each other in such configuration (the corners would have to be open to accommodate the framing members), such embodiments may be helpful where underside access is limited, such as retrofitting. Such configurations could have one, two, three, four, or more vertical members 12.

In a preferred embodiment, the attachment holes 24 in the horizontal plate 2 may be countersunk or otherwise opened to accommodate the head of the fastener 22, so that the heads are either flush with or protrude minimally above the top surface 3 of the horizontal plate 2, while maintaining sufficient strength of the horizontal plate 2. This will help maintain a relatively smooth surface on the horizontal plate 2 for either the roof sheathing 28 or the roofing membrane 30.

Figure 8:
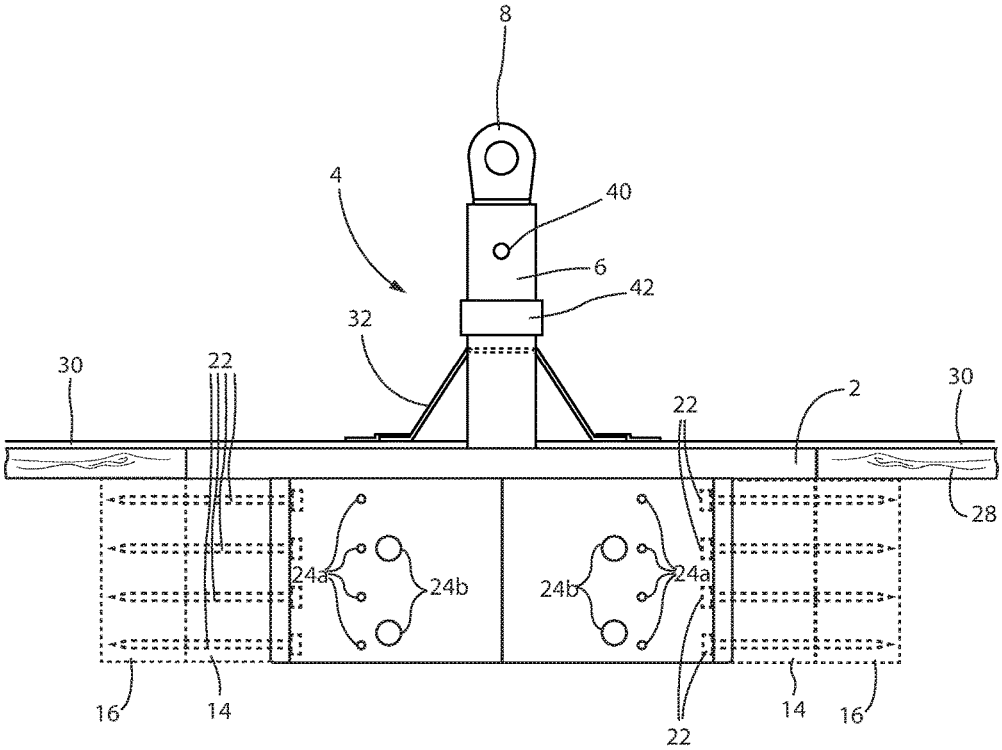
FIG. 8 depicts a side cut-away view of a fall protection anchor installed into the framing members with roofing materials and flashing.

As shown in FIG. 8, because the horizontal plate 2 is preferably installed directly over the framing, the roof sheathing 28 may be installed around the horizontal plate 2. Given that the preferred thickness of the horizontal plate 2 is 0.5 inches to 0.75 inches, and typical roof sheathing 28 is ⅝ inch (16 mm) or ¾ inch (19 mm) plywood or the like, the horizontal plate 2 will be close to flush with the roof sheathing 28. This will ease the installation of the roofing materials. If desired, a thin sheet of plywood, such as ¼ inch (6 mm), could be used to either cover or surround the horizontal plate 2 and aide the smooth transition for the roofing material 30, while covering the heads of any fasteners 22 used to secure the horizontal plate 2 to the framing.

Alternatively, the horizontal plate 2 may be installed above or below the roof sheathing 28. To reduce the stress on roof sheathing 28 or roofing membrane 30 placed atop the right-angle edges of the horizontal plate 2, the edges and/or corners of the horizontal plate 2 may be rounded or tapered to ease the transition, and may even be extended with a tapering edge. Alternatively, a tapered edge could be installed adjacent to the horizontal plate, made of wood, plastic, metal or any other suitable material.

Alternatively, rather than countersinking the attachment holes in the horizontal plate 2, a transition cover (not shown) could be used to cover and/or approximate the height of the heads of the fasteners 22 so that the transition cover provides a generally smooth and substantially continuous surface above the horizontal plate 2 and its fasteners 22, and may also provide an edge transition for the horizontal plate 2. Such a transition cover may allow the horizontal plate 2 to be thinner due to the lack of countersinking, which would reduce cost of the horizontal plate 2 both in material cost (thinner plate is cheaper) and machining cost (for the countersinking). The transition cover could be single or multiple pieces, and used above or below the roof sheathing 28. As a non-limiting example of such a transition cover, if the thickness of the heads of the fasteners 22 and the horizontal plate 2 are both 0.25 inches (6.35 mm), a top cover in the same shape as the horizontal plate could be fashioned from 0.25 inch plywood with holes cut out to accommodate the fastener heads and the anchor post 6. One or more pieces of material that match up to the combined height of the plate and the top cover (0.25+0.25=0.5 inches) could be placed against the edge of the horizontal plate 2 and taper outwardly from the horizontal plate 2.

As show on FIG. 8, on a flat roof installation, the anchor connection 4 may penetrate the roofing membrane 30. The penetration may be sealed by conventional methods, such as flashing 32, sealants, etc.

Alternatively, the fall protection anchor 1 need not be installed solely on flat rooftops. It may also be employed on the side of a building, on sloped surfaces including but not limited to roofs, or even on ceilings or overhangs. The framing and fasteners must be sufficient to accommodate such placement. For such alternative installations, the construction of the fall protection anchor 1 could be different, such as having both the anchor post 6 and the vertical members 12 attached to the bottom surface 5 of the horizontal plate 2. For such installations, the "top" and "bottom" surfaces of the horizontal plate 2 would merely refer to opposite sides, and not necessarily the direction the surface is facing.

A prototype of the fall protection anchor 1 was tested to make sure it conformed to the regulatory requirements and design parameters. The prototype comprised a 18.5-inch square horizontal plate 2 and a 3.5-inch square anchor post 6 that was 16 inches tall and ⅜-inch wall thickness, with a forged eye bolt as a connection attachment 8, and four vertical members 12*a*, 12*b*, 12*c*, and 12*d*, 0.25 inches thick. The horizontal plate 2 had 16 attachment holes 24 on the top at the outside edges. The four vertical members 12*a*, 12*b*, 12*c*, and 12*d*, had nine holes (three on each end and three at the center of each skirt). The horizontal plate 2, vertical members 12*a*, 12*b*, 12*c*, and 12*d*, and tube steel post 6 were ASTM A36 material. The vertical members 12*a*, 12*b*, 12*c*, and 12*d*, and tube steel post 6 were welded to the ½-in. thick horizontal plate 2 (all welds were a minimum of ⅛-in. beads). One 10,000 pound tension proof load and four 5,000 pound lateral proof loads were tested, with the force applied at the eye bolt.

The test equipment utilized in the test program consisted of a loading system, a load cell, displacement instruments, and test fixtures. The loading system consisted of an Enerpac hydraulic ram and hand pump. The load cell was a Sensotec 75,000-lbs. capacity compression load cell. The displacement instruments consisted of digital indicators that had been calibrated within four months of the testing. The test fixtures connected the test equipment to the eye-bolt. The fall protection anchor 1 was mounted into a test rig comprising two 6×10 long timbers and two 4×10 blocking timbers attached with Simpson HUS410 hangers. The fall protection anchor 1 was attached to these timbers with Simpson SDS ¼"×3" wood screws, 16 screws in the horizontal plate 2, and 24 screws in the vertical members 12*a*, 12*b*, 12*c*, and 12*d* (six screws per member, with three at each lateral edge).

The 5,000-pound lateral proof load was applied in 500-pound increments. The proof load was held for a duration of 3-minutes. Displacement readings were recorded at each load increment, after achieving the proof load and after the load hold duration of 3-minutes was achieved. All four directions were separately tested, and all four tests resulted in no observed failure of the fall protection device 1. The largest measured displacement occurred from the horizontal bending of the anchor post 6, with displacements at the top of the post ranging from 0.766-0.957 inches at the end of the max load period, and 0.250-0.458 inches when the load was released. The anchor post 6 torsion displacement (uplift) measured at the top of the post ranged from 0.313-0.444 inches at the end of the max load period, and 0.110-0.191 inches when the load was released. The horizontal plate 2 tension displacement (uplift) measured from 0.031-0.094 inches at the end of the max load period, and 0.021-0.033 inches when the load was released. The horizontal plate 2 compression displacement (downward) measured from 0.096-0.154 inches at the end of the max load period, and 0.030-0.051 inches when the load was released.

The 10,000-pound tension proof load was applied in 1,000-pound increments. The proof load was held for a duration of 3-minutes. Displacement readings were recorded at each load increment, after achieving the proof load and after the load hold duration of 3-minutes was achieved. Once again, the test resulted in no observed failure of the fall protection device 1. The displacement measured at the top of the anchor post 6 ranged from 0.109 inches at the end of the max load period, and 0.013 inches when the load was released. The horizontal plate tension displacement (uplift), measured from 0.066 inches at the end of the max load period, and 0.005 inches when the load was released.

A method of constructing the fall protection anchor 1 disclosed herein may comprise providing a horizontal plate with a top surface and bottom surface, at least one vertical member, and an anchor connection, coupling the anchor connection with the top surface of the horizontal plate, and welding at least one vertical member perpendicularly to the bottom surface of the horizontal plate, wherein the vertical and/or horizontal plates may have attachment holes to accommodate fasteners.

A method for installing the fall protection anchor 1 disclosed herein may comprise providing fall protection device comprising a horizontal plate with a top and bottom surface, an anchor connection coupled with the top surface of the horizontal plate, and at least one vertical member perpendicularly coupled with the bottom surface of the horizontal plate, wherein the horizontal plate and/or vertical member(s) may have attachment holes to accommodate fasteners, providing an opening in a building framing to accommodate the vertical member(s) in close relation so that the vertical member(s) face the framing, installing fasteners through the attachment holes of the horizontal and/or vertical members and into the framing. A method of using such an installed fall protection anchor 1 may comprise coupling a connection device 10 to the anchor connection 4, and coupling the connection device 10 to a body support of a worker.

The foregoing fall protection anchor is not limited to installation in wood-framed buildings. The fall protection anchor 1 may be adapted to metal-framed buildings as well. Fasteners would have to be suitable for use on metal framing, or wooden framing would have to be attached to the metal framing to install the fall protection anchor 1 as discussed above.

Figure 9:
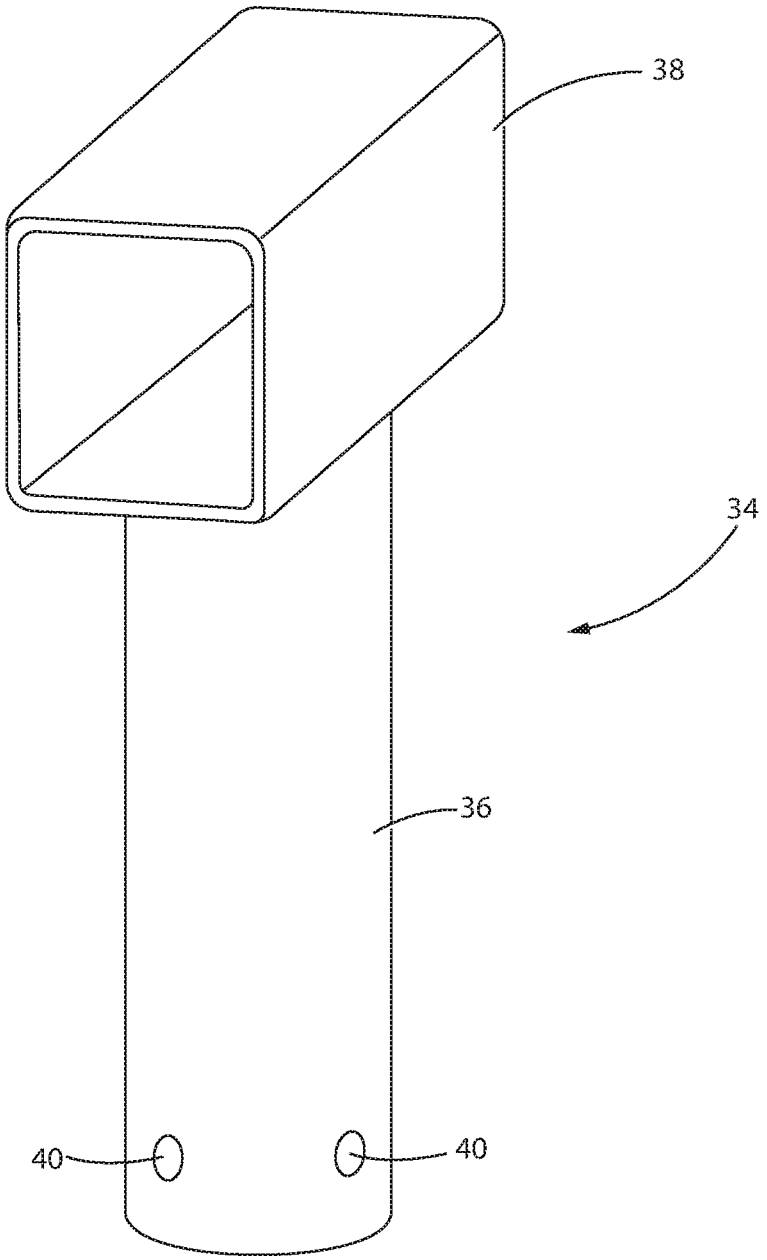
FIG. 9 depicts a depicts a perspective view of an outrigger support.
Figure 10:
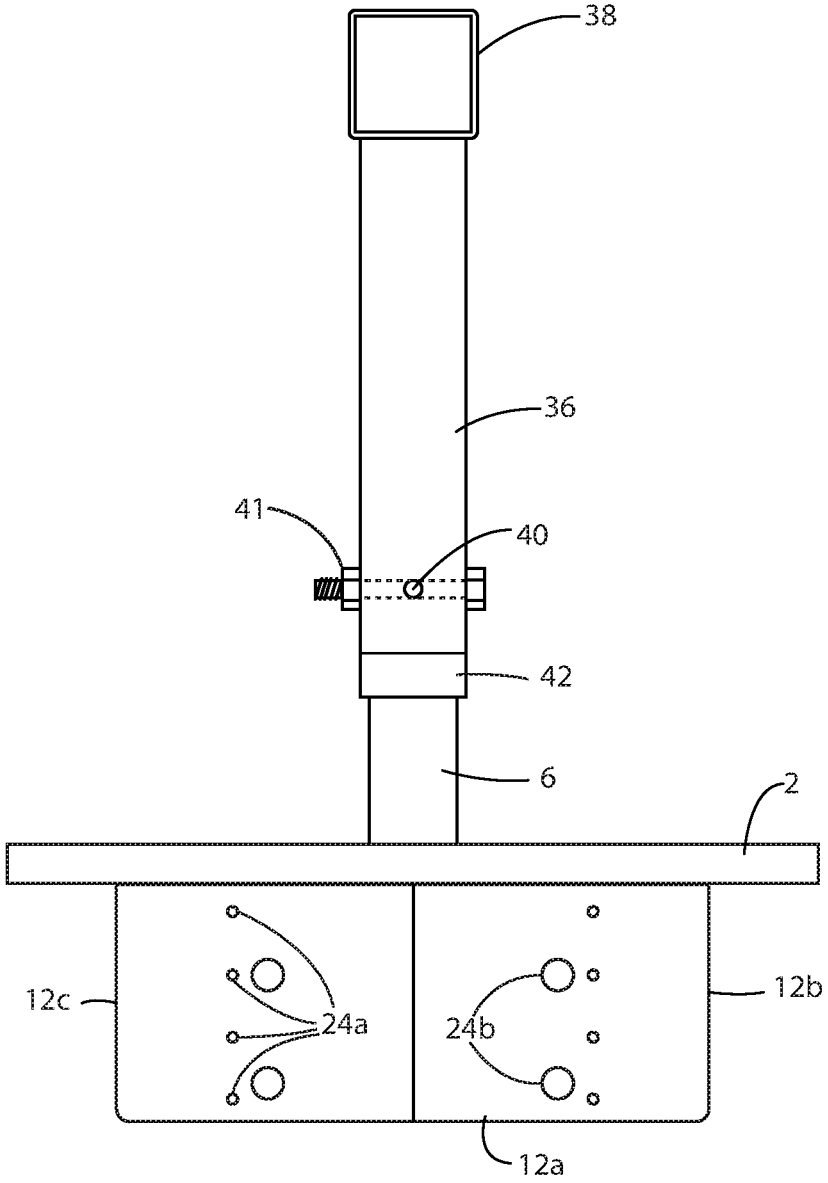
FIG. 10 depicts a depicts a side view of an outrigger support mounted onto a fall protection anchor.
Figure 11:
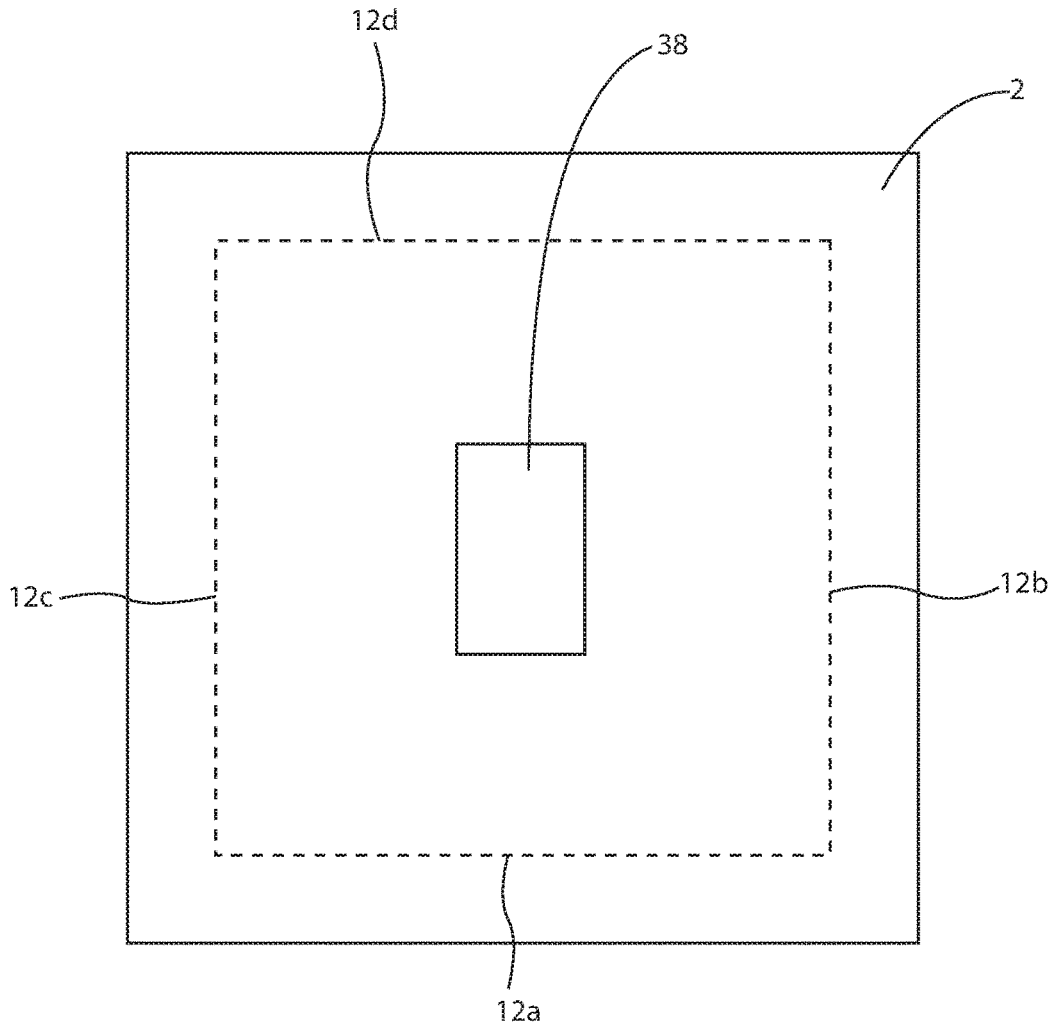
FIG. 11 depicts a depicts a top view of an outrigger support mounted onto a fall protection anchor.
Figure 12:
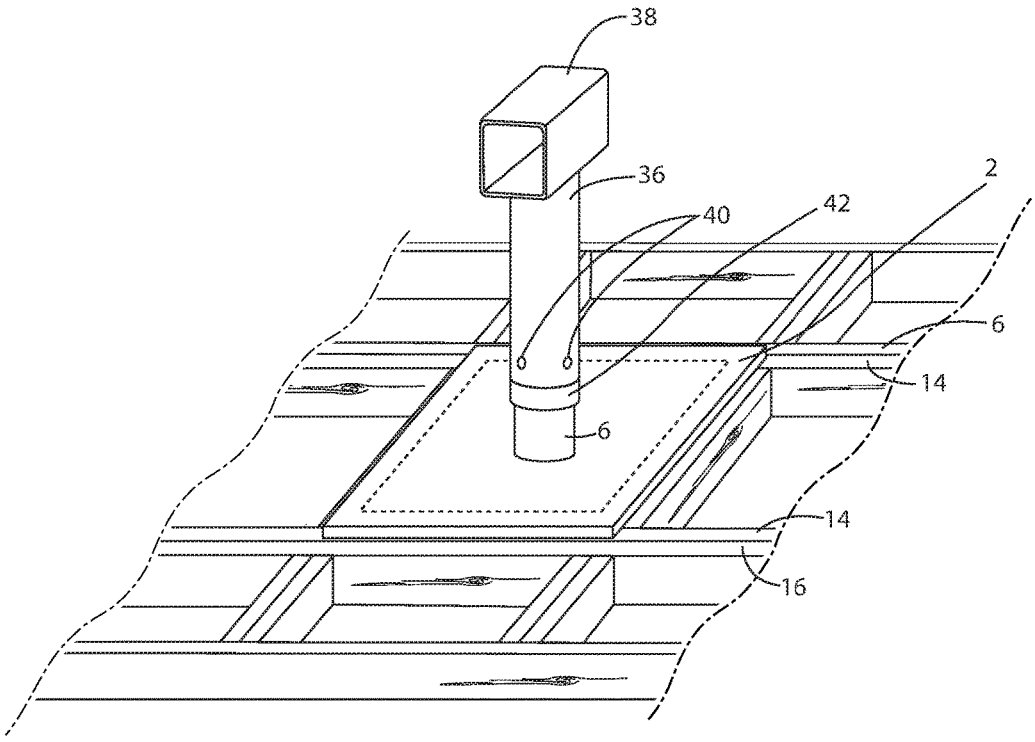
FIG. 12 depicts a depicts a perspective view of an outrigger support mounted onto a fall protection anchor after it is placed into framing members.
Figure 13:
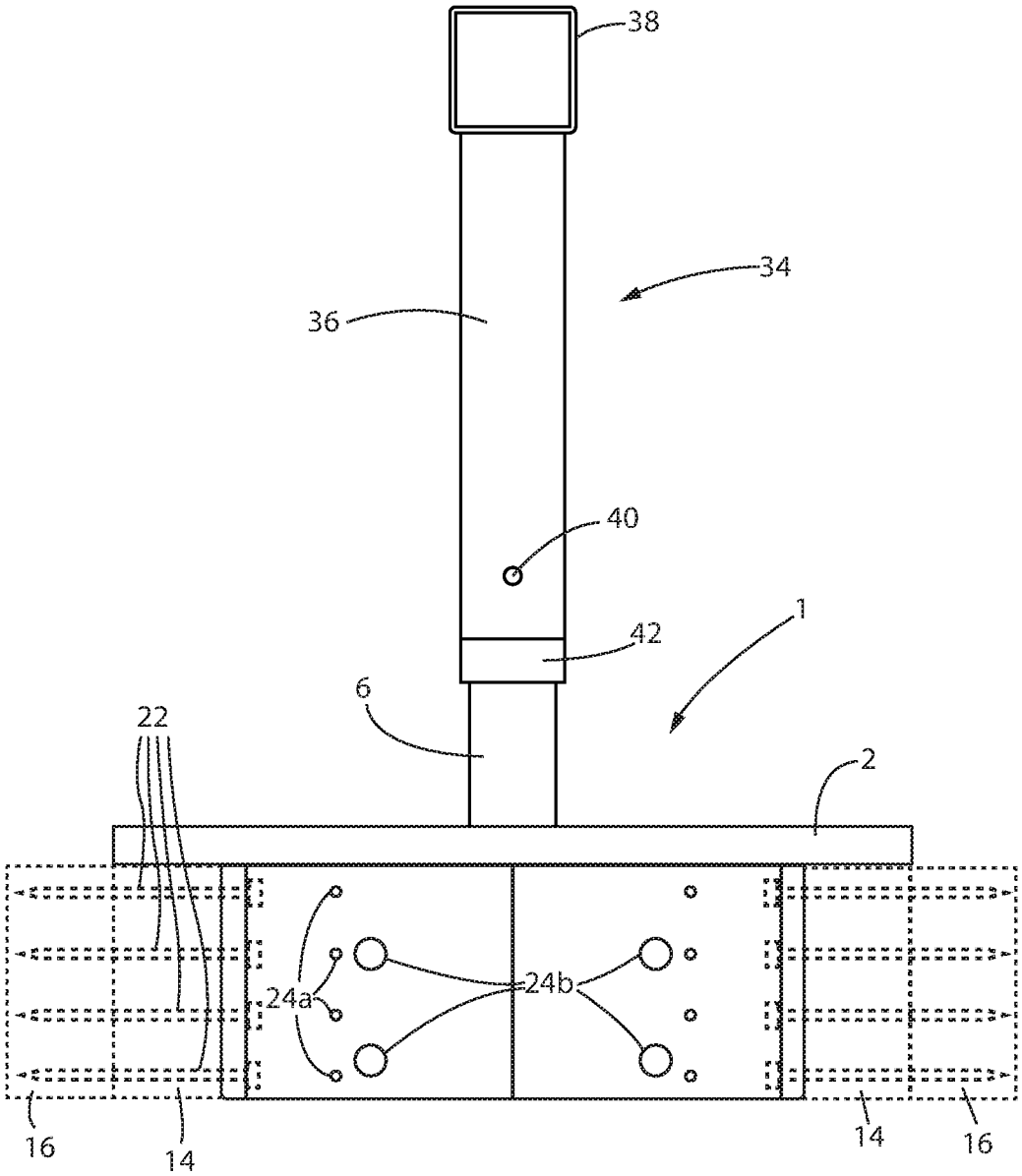
FIG. 13 depicts a side cut-away view of an outrigger support mounted onto a fall protection anchor installed into the framing members.

The fall protection anchor 1 discussed above, may be used in connection with an outrigger support 34 shown in FIG. 9. The outrigger support 34 comprises a support post 36 and a beam holder 38. The outrigger support 34 may also be equipped with at least two security holes 40 on either side of the support post 36 to accommodate a security fitting such as a through-bolt 41. In alternative embodiments, no security holes need be used. Still other alternative embodiments may incorporate other security fittings that prevent the outrigger support 34 from detaching from the fall protection anchor 1.

In a preferred embodiment shown in FIGS. 10-13, the support post 36 is sized to fit over the anchor post 6 with a minimal amount of play. The anchor post 6 is preferably a 3.5 inch x-strong pipe with a nominal OD of 4.00 inches, while the support post 36 is preferably a 4.5 inch x-strong pipe with a wall thickness of 0.375 inches, a nominal OD of 5.00 inches, and a nominal ID of 4.25 inches. Preferably the support post 36 is 42 inches long, and the beam holder 38 is a 6.0 inch OD square tube of 0.25 inch steel that is 10.0 inches long, and attached perpendicularly to the support post 36, preferably by welding, although other attachment methods may be used. In alternative embodiments, the beam holder 38 may be a different configuration, such as a U-shaped channel to support the outrigger beam 44, with a bolt over the top or through the beam 44. Preferably, a pair of security holes 40 on either side of the support post 36 is located 2.875 inches above the bottom of the support post 36, the security holes 40 measuring 0.875 inches in diameter to accept a 0.75 inch bolt 41. The security bolt 40 secures the support post 36 to the anchor post 6 during use, and as explained below, may also act as an alternative connection attachment 8 with the proper fitting. In alternative embodiment, other security apparatus may be used to prevent the support post 36 from separating from the anchor post 6. Preferably the assembled outrigger support 34 is hot dipped galvanized, although other anti-corrosion treatments or corrosion-resistant materials may be used. In alternative embodiments, any and all of these dimensions may be modified.

The fall protection anchor 1 to be used with the above embodiment would preferably have an anchor post 6 constructed of 3.5 inch X-strong pipe with a nominal OD of 4.00 inches and a total length of 24 inches, although other lengths may be used. In this embodiment, the preferred height of vertical members 12 are 9.75 inches, each vertical member 12 may define eight small attachment holes 24*a* and four large attachment holes 24*b*. The horizontal plate 2 is preferably 0.75 inches thick. Preferably the anchor post 6 would be equipped with a stop ring 42, which may be 2.0 inches long and made of the same material as the support post 36, a 4.5 inch x-strong pipe with a wall thickness of 0.375 inches, a nominal OD of 5.00 inches, and a nominal ID of 4.25 inches. Preferably the stop ring 42 is welded to the anchor post 6 along the bottom of the stop ring 42, although other attachment methods may be used. Preferably the top of the stop ring 42 is located 18 inches from the bottom of the anchor post 6 and 6.0 inches from the top of the anchor post 6. Preferably the anchor post 6 is equipped with two security holes 40 on opposite sides of the anchor post 6 that are located 3.0 inches above the top of the stop ring 42 and 3.0 inches below the top of the anchor post 6, so that they line up with the security holes 40 in the outrigger support 36. Preferably, the security holes 40 are oriented perpendicular to the sides of the rectangular plate 2. In an alternative embodiment, four such security holes 40 placed 90 degrees from each other around the anchor post 6 would allow the fall protection anchor 1 to be installed in either direction and still have security holes 40 that are properly aligned for use with an outrigger support 34. Alternatively, the four security holes 40 could be in the support post 36, while two security holes 40 could be in the anchor post 6, with the same function. The stop ring 42 helps line up the security holes 40 in the anchor post 6 and support post 36, and prevents the support post 36 from getting stuck on the bottom of the anchor post 6, where welds or other imperfections may tend to jam the support post 36. In alternative embodiments, the anchor post 6 need not be equipped with a stop ring 42 and/or or security holes 40. In alternative embodiments, any and all of these dimensions and/or orientations may be modified.

Figure 14:
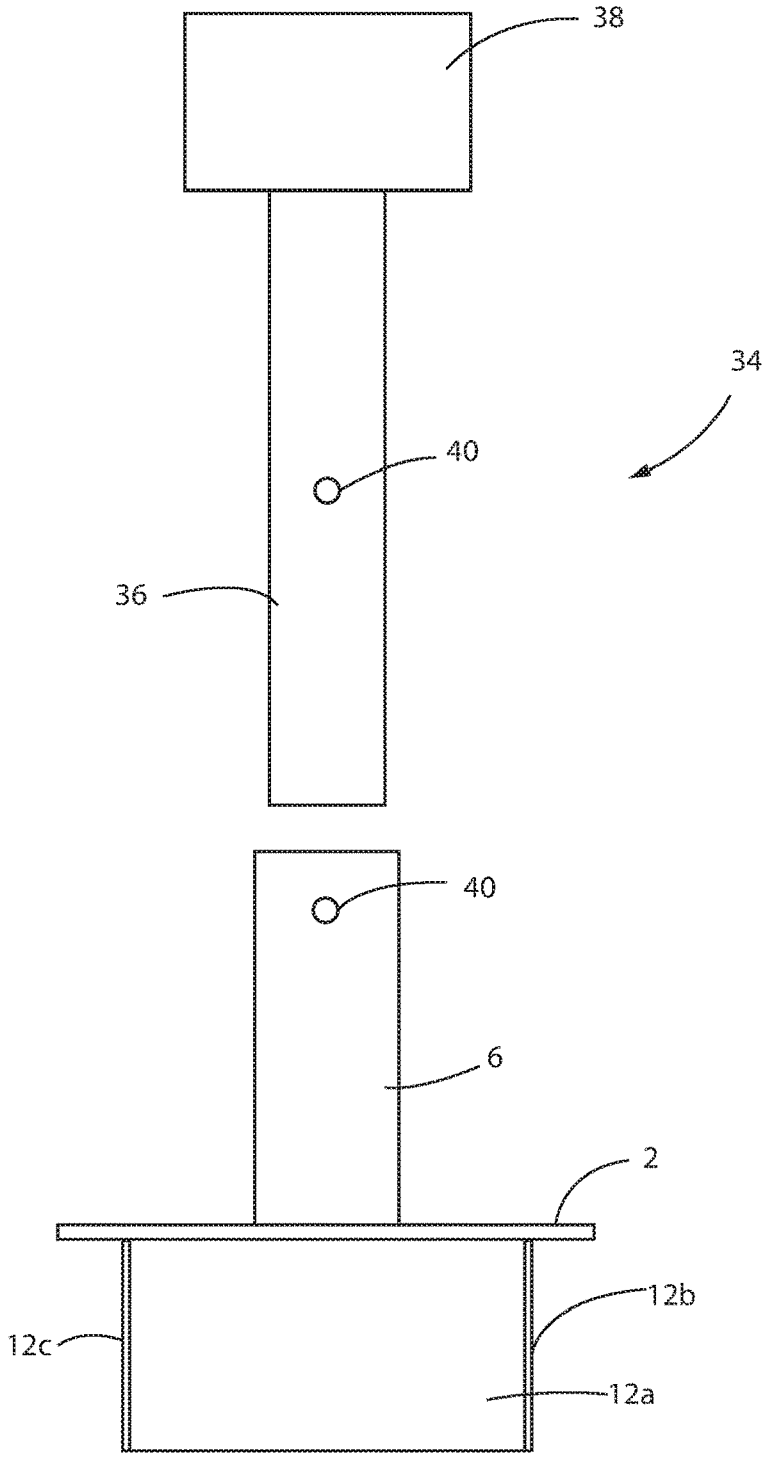
FIG. 14 depicts a side view of an alternative embodiment of the present invention.

In an alternative embodiment of the outrigger support 34, the pipe diameters could be reversed on the anchor post 6 and the support post 36. In a preferred embodiment shown in FIG. 14, an anchor post 6 may comprise a 5.0 inch nominal OD pipe with a 0.375 wall thickness, 13 inches long, with at least two security holes 40 on either side of the anchor post 6 located 2.0 inches below the top of the anchor post 6. Preferably, the support post 36 would be 3.5-inch x-strong pipe that is 60 inches long with at least one pair of security holes 40 located 10.875 inches above the bottom of the support post 36 to correspond to the security holes 40 in the anchor post 6. The beam holder 38 may be a 6.0-inch OD square tube of 0.25-inch steel that is 10.0 inches long, and attached perpendicularly to the support post 36, preferably by welding, although other attachment methods may be used. A cap constructed of 5-inch schedule 10 pipe (5.3-inch ID) that is 3.5 inches long attached to a 6.25-inch circle of 0.25-inch plate may be used to cover the support post 36 and the security holes 40 when the support post 36 is not placed over the anchor post 6. A threaded cap could also be used by threading anchor post 6. The bottom of the anchor post 6 may be equipped with drainage hole(s), and any holes in the horizontal plate 2 within the circumference of the anchor post 6 may be plugged to prevent water intrusion. In alternative embodiments, any and all of these dimensions and/or orientations may be modified. To use this embodiment as a fall protection anchor, a heavy duty eye bolt, large U-shaped shackle, or other suitable fitting may be placed through the security holes 40 of the anchor post 6 to act as a connection attachment 8, either with or without the outrigger support 34.

In an alternative embodiment, the outrigger support 34 could be permanently mounted to the fall protection anchor 1. In such an embodiment, the anchor post 6 could be eliminated, and the support post 36 could be directly attached to the horizontal plate 2, preferably by welding, although other attachment methods may be used. Alternatively, the anchor post 6 may be used, and the support post 36 may be welded or otherwise permanently attached to the anchor post 6 and/or the horizontal plate 2. To use this embodiment as a fall protection anchor, one or more security holes 40 may be placed in the outrigger support 34, and a heavy duty eye bolt, a large U-shaped shackle, carabiner, or other suitable fitting(s) may be placed through the security hole(s) 40 to act as a connection attachment 8. Other suitable fittings that do not require security holes 40 may also be used to secure a connection attachment 8 to the support post.

Figure 15:
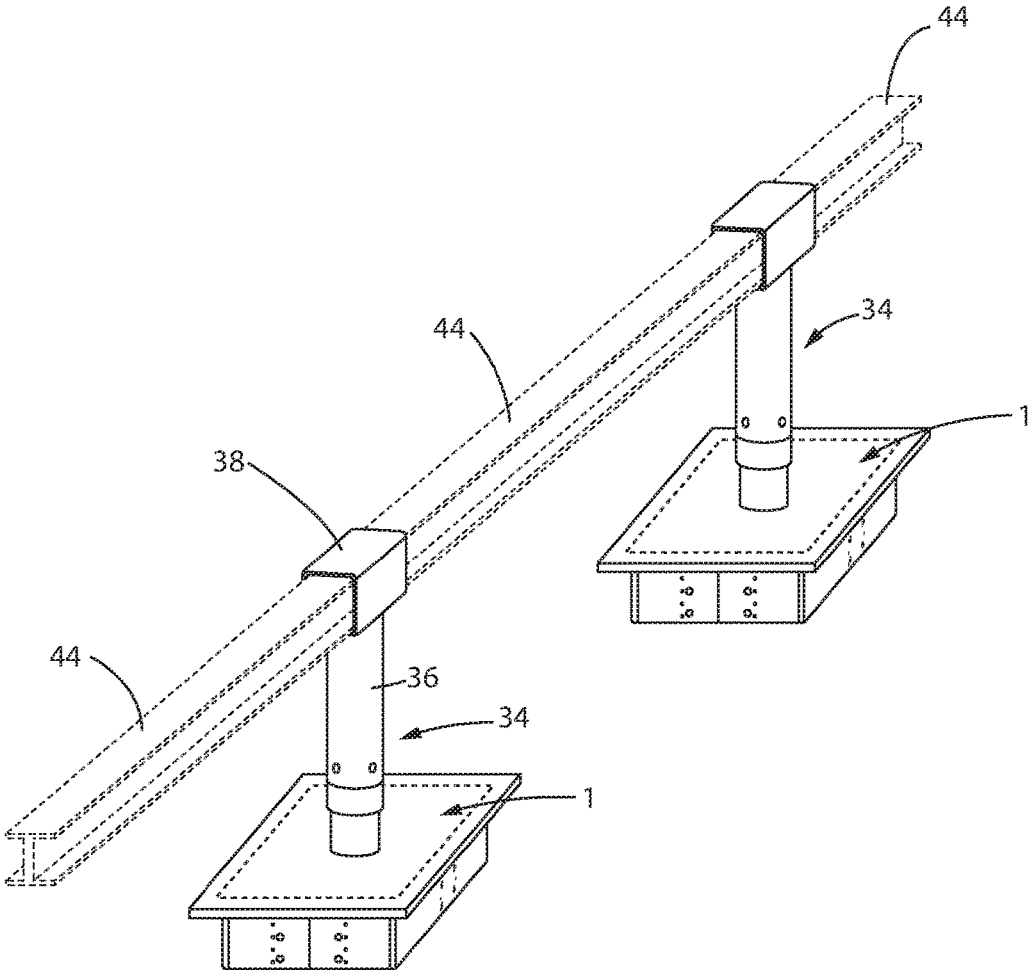
FIG. 15 depicts a perspective view of two outrigger supports mounted onto two fall protection anchors, holding an outrigger beam.

As shown in FIG. 15, two outrigger supports 34 may be used to support an outrigger beam 44, so the outrigger beam 44 can overhang the side of a building to provide fall protection or support for workers, such as scaffolding, harness, or a bosun chair. The outrigger beam 44 is typically equipped with a rigging plate for supporting such apparatus and a stop to prevent the outrigger beam 44 from falling out of the beam holder 38. Given the permanent robust mounting of the fall protection anchor 1, however, counterweights should not be required for safe use of the outrigger beam 44 when used with two outrigger supports 34. The two outrigger supports 34 used to support one outrigger beam 44 may be different heights. In such an arrangement, the beam holder 38 would have to be adapted to accommodate the angle of the outrigger beam 44, either by attaching the beam holder 38 to the support post 36 at a fixed angle, attaching the beam holder 38 to the support post 36 with a pivot that can accommodate various angles, or using a beam holder 38 that allows some angular movement, such as a U-shaped channel with a bolt over or through the beam 44.

Alternatively, a single outrigger support 34 could be used with an outrigger beam 44, using counterweights. The outrigger support 34 may be located near the edge of the building, holding the short end of the outrigger beam 44, while longer end of the outrigger beam 44 would be equipped with counterweights sufficient to support the load. The outrigger beam 44 may be equipped with a fitting that coordinates with the outrigger support 34, specifically the beam holder 38, to prevent the beam from sliding within the beam holder 38 during use. This could be a simple through-bolt or other suitable apparatus to prevent the beam from sliding. Alternatively, the end of the outrigger beam 44 with the counterweights could be secured to prevent such movement. The beam holder 38 could also be attached to the support post 36 at an angle, rather than perpendicular, so that the outrigger beam 44 could angle down toward the roof to allow easier placement of the counterweights on the end of the beam. Alternatively, the beam holder 38 may be attached to the support post 36 with a pivoting mechanism to allow the beam 44 to be angled as necessary. The pivot could also have a restricted range of movement.

A method of installing a support for an outrigger beam on a building having first and second parallel horizontal framing members 14, and blocking created by third and fourth horizontal framing members 18 that each have two ends and are substantially perpendicular to and coupled with the first and second framing members to form a rectangle of horizontal framing, may include providing a fall protection anchor 1 comprising a horizontal plate 2 that at least partially covers at least two of the horizontal framing members, a substantially vertical anchor post 6 attached to the top of the horizontal plate 2, four vertical members 12 coupled with a bottom of the horizontal plate 2 and coupled to each other at substantially right angles to form a box that fits within the rectangle of horizontal framing 14 18, each of the four vertical members 12 having an attachment hole 24, and each of the four vertical members 12 facing one of the horizontal framing members 14 18. The method continues by placing the fall protection anchor 1 atop at least two of the horizontal framing members 14 or 18, positioning the vertical members 12 to face the horizontal framing members, fastening the fall protection anchor 1 to the rectangle of horizontal framing 14 18 by inserting a first set of fasteners 22 through at least some of the attachment holes 24 and into at least some of the horizontal framing members 14 and/or 18. The method further continues by providing an outrigger beam support 34 comprising a support post 36 with two ends, with a first end that is sized to operatively and detachably couple with the anchor post 6, and a beam holder 38 attached to a second end of the support post 38, and continues by connecting the outrigger beam support 34 to the fall protection anchor 1 by coupling it with the anchor post 6.

As a further method of installing a support for an outrigger beam, the method may include the steps outlined above, plus installing a second fall protection anchor 1 in a second rectangle of horizontal framing 14 18 and connecting a second outrigger beam support 34 with a second beam holder 38 to the second fall protection anchor 1 as described above, and locating the second fall protection anchor 1 and second outrigger beam support 34 so that an outrigger beam 44 may span both the first and second beam holders 38.

As a further method of installing a support for an outrigger beam, the method may include the steps outlined above, plus having the anchor post 6 and the support post 36 each define a pair of corresponding security holes 40, and placing a security fitting 41 through each pair of holes 40.

As a further method of installing and using a support for an outrigger beam, the method may include the steps outlined above, wherein the security fitting 41 further comprises a connection attachment 8, and connecting a connection device 10 to the connection attachment 8.

The foregoing description of the preferred embodiment of the invention has been presented for the purposes of illustration and description. It is not intended to be exhaustive or to limit the invention to the precise form disclosed. Modifications and variations are possible in light of the above teaching. It is intended that the scope of the invention not be limited by this detailed description, but by the claims and the equivalents to the claims appended hereto.

What is claimed is:

1. A support for an outrigger beam for a building, comprising:

a) a fall protection anchor comprising:

i) a rectangular plate comprising four edges, a first surface, and a second surface opposite the first surface, the four edges defining a perimeter of the rectangular plate;

ii) an anchor post comprising a first end and a second end, the first end coupled with the first surface of the rectangular plate and located substantially centrally thereon, and the anchor post oriented substantially perpendicular to the rectangular plate;

iii) four members, each of the four members being substantially planar, and each of the four members attached substantially perpendicularly to the second surface of the rectangular plate and each of the four members oriented substantially perpendicularly to two other members of the four members to form a rectangular box of members on the second surface of the rectangular plate, wherein at least two members of the four members are spaced inwardly from the perimeter of the rectangular plate, wherein at least one member of the four members defines an attachment hole configured to accept a fastener;

b) an outrigger support comprising:

i) a support post comprising a first end and a second end, the first end of the support post is sized to operatively and detachably couple with the anchor post; and ii) a beam holder attached to the second end of the support post.

2. The support of claim 1, further comprising a connection attachment affixed to the second end of the anchor post.

3. The support of claim 1, wherein the anchor post further comprises a stop ring to position the support post.

4. The support of claim 1, wherein the anchor post and the support post each define a pair of security holes adapted to accommodate a security fitting.

5. The support of claim 1, wherein the anchor post further comprises a connection attachment.

6. The support of claim 1, wherein each of the four members defines an attachment hole configured to accept a fastener.

7. The support of claim 1, wherein the rectangular plate defines multiple attachment holes located between the perimeter and at least two members of the four members, wherein each of the attachment holes is configured to accept a fastener.

8. The support of claim 1, wherein the four members are spaced inwardly from the perimeter of the rectangular plate.

9. A support for an outrigger beam for a building, comprising:

a) a plate comprising a first surface, a second surface opposite the first surface, and a perimeter;

b) an anchor post comprising a first end and a second end, the first end coupled with the first surface of the plate, and the anchor post oriented substantially perpendicular to the plate and located substantially centrally on the first surface of the plate;

c) a first member and a second member, each of the first and second members being substantially planar with a plurality of edges, and each of the first and second members is attached substantially perpendicularly along one of the plurality of edges to the second surface of the plate, at least one member of the first and second members spaced inwardly from the perimeter of the plate, each of the first and second members defining an attachment hole;

d) a support post comprising a first end and a second end, wherein the first end of the support post is adapted to operatively and detachably couple with the anchor post; and e) a beam holder attached to the second end of the support post.

10. The support of claim 9, further comprising a third member and a fourth member, each of the third and fourth members having a plurality of edges, respectively, the third and fourth members each defining an attachment hole, wherein the third member is attached substantially perpendicularly along one of the plurality of edges of the third member to the second surface of the plate and the fourth member is attached substantially perpendicularly along one of the plurality of the edges of the fourth member to the second surface of the plate.

11. The support of claim 10, wherein the first member, the second member, the third member, and the fourth member are arranged to form a box-like configuration.

12. The support of claim 11, wherein the plate further defines a second set of attachment holes adjacent to the perimeter of the plate.

13. The support of claim 12, wherein the second set of attachment holes are located between the perimeter of the plate and the box-like configuration.

14. A support for an outrigger beam for a building, comprising:

a rectangular plate comprising four edges, a first surface, and a second surface opposite the first surface, the four edges defining a perimeter of the rectangular plate;

a support post comprising a first end and a second end, the first end attached to the first surface of the rectangular plate and located substantially centrally thereon, the support post oriented substantially perpendicular to the rectangular plate;

a beam holder attached to the second end of the support post; and four members, each being substantially planar, and each of the four members attached substantially perpendicularly to the second surface of the rectangular plate and each of the four members oriented substantially perpendicularly to two other members of the four members to form a rectangular box of members on the second surface of the rectangular plate, at least two members of said rectangular box of members spaced inwardly from the perimeter of the rectangular plate, wherein at least one member of said rectangular box of members defines an attachment hole configured to accept a fastener.

15. The support of claim 14, wherein the support post defines a pair of security holes adapted to accommodate a connection attachment placed through the security holes.

16. The support of claim 14, wherein the rectangular plate defines multiple attachment holes located between the perimeter and at least one member of the four members, wherein each of the attachment holes is configured to accept one of a plurality of fasteners.

17. A method of installing a support for an outrigger beam on a building having first and second parallel horizontal framing members, and a blocking created by third and fourth horizontal framing members that each have two ends and are substantially perpendicular to and coupled with the first and second horizontal framing members to form a rectangle of horizontal framing, the method comprising:

a. providing a fall protection anchor comprising:

i. a horizontal plate with a substantially planar top and bottom, wherein the horizontal plate at least partially covers at least two of the horizontal framing members;

ii. a substantially vertical anchor post attached to the top of the horizontal plate;

iii. four vertical members coupled with the bottom of the horizontal plate and coupled to each other at substantially right angles to form a box that fits within the rectangle of horizontal framing, each of the four vertical members having an attachment hole, and each of the four vertical members facing one of the horizontal framing members, wherein at least two of the vertical members have a fastener through an attachment hole to secure the four vertical members to the horizontal framing members;

b. providing an outrigger beam support comprising:

i. a support post with a first end and a second end, wherein the first end of the support post is sized to operatively and detachably couple with the anchor post; and ii. a beam holder attached to the second end of the support post;

c. connecting the outrigger beam support to the anchor post.

18. The method of installing a support for an outrigger beam of claim 17, wherein the anchor post and the support post each define a pair of corresponding security holes, and placing a security fitting through each pair of holes.

19. The method of installing a support for an outrigger beam of claim 17, further comprising installing a second fall protection anchor in a second rectangle of horizontal framing and connecting a second outrigger beam support with a second beam holder to the second fall protection anchor, and locating the second fall protection anchor and second outrigger beam support so that an outrigger beam may span both the first and second beam holders.

* * * * *